US009433251B2

(12) United States Patent
McLoughlin

(10) Patent No.: US 9,433,251 B2
(45) Date of Patent: Sep. 6, 2016

(54) SLEEVE AND GLOVE KEEPER WATCH BRACKET

(71) Applicant: John E. McLoughlin, Hauppauge, NY (US)

(72) Inventor: John E. McLoughlin, Hauppauge, NY (US)

( * ) Notice: Subject to any disclaimer, the term of this patent is extended or adjusted under 35 U.S.C. 154(b) by 0 days.

(21) Appl. No.: 14/973,711

(22) Filed: Dec. 17, 2015

(65) Prior Publication Data

US 2016/0100643 A1 Apr. 14, 2016

Related U.S. Application Data

(63) Continuation-in-part of application No. 14/217,729, filed on Mar. 18, 2014, which is a continuation-in-part of application No. 14/138,248, filed on Dec. 23, 2013.

(51) Int. Cl.

| | |
|---|---|
| ***G04B 47/00*** | (2006.01) |
| ***A41F 19/00*** | (2006.01) |
| ***A44B 99/00*** | (2010.01) |
| ***A41F 1/00*** | (2006.01) |

(52) U.S. Cl.

CPC ..... *A41F 19/005* (2013.01); *A41F 1/002* (2013.01); *A44B 99/00* (2013.01); *G04B 47/00* (2013.01)

(58) Field of Classification Search

CPC ..... G04B 47/00; A41F 19/00; A41F 1/002; A41F 19/005

USPC ..... 2/59, 231

See application file for complete search history.

(56) References Cited

U.S. PATENT DOCUMENTS

| | | | | |
|---|---|---|---|---|
| 979,306 | A | 12/1910 | Hustace et al. | |
| 1,479,008 | A | 1/1924 | Powers | |
| 1,483,731 | A | 2/1924 | Kirk | |
| 2,000,923 | A | 5/1935 | Colbiornsen | |
| 2,509,428 | A | 5/1950 | Wallace | |
| 3,462,809 | A | 8/1969 | Froehlich, Jr. | |
| 3,584,455 | A | 6/1971 | Sion | |
| 3,885,383 | A * | 5/1975 | Tanaka | A44C 5/0023 224/175 |
| 3,962,758 | A | 6/1976 | Knappe et al. | |
| 4,353,124 | A | 10/1982 | Weinzettel et al. | |
| 4,571,199 | A * | 2/1986 | Murakami | G04B 37/0008 446/135 |
| 4,939,913 | A | 7/1990 | Scungio et al. | |
| 4,941,236 | A * | 7/1990 | Sherman | A44C 5/2071 24/265 WS |
| 5,467,324 | A | 11/1995 | Houlihan | |
| 5,513,154 | A | 4/1996 | Beckwith | |
| 5,546,641 | A | 8/1996 | Radvin et al. | |
| 5,610,877 | A | 3/1997 | Adams et al. | |
| 5,889,737 | A * | 3/1999 | Alameh | G04C 10/00 368/204 |
| 6,366,538 | B1 | 4/2002 | Anderson et al. | |
| 6,480,441 | B1 | 11/2002 | McKay | |

(Continued)

FOREIGN PATENT DOCUMENTS

| | | | |
|---|---|---|---|
| EP | 1074190 | A2 | 2/2001 |
| EP | 1143310 | A2 | 10/2001 |
| WO | 2011086439 | A1 | 7/2011 |

*Primary Examiner* — Sean Kayes

(74) *Attorney, Agent, or Firm* — Wei Wei Jeang; Grable Martin Fulton PLLC

(57) ABSTRACT

A sleeve keeper for use with a wrist accessory or wristwatch worn by a user includes a first magnetic member coupled to the wrist accessory, and a second magnetic member coupled to the wrist accessory and being attracted to the first magnetic member to hold and retain, between the first and second magnetic members, a long sleeve of a garment worn by the user from obscuring the wrist accessory.

16 Claims, 10 Drawing Sheets

(56) References Cited

U.S. PATENT DOCUMENTS

| | | | | |
|---|---|---|---|---|
| 6,519,207 | B1 | 2/2003 | Lukacsko | |
| 6,799,887 | B1 | 10/2004 | Kinney | |
| 6,817,192 | B2 * | 11/2004 | Ector, Jr. | G01N 33/02 206/459.1 |
| 7,124,447 | B2 | 10/2006 | Arganese | |
| 7,380,287 | B2 | 6/2008 | DeSantis | |
| 7,610,944 | B2 * | 11/2009 | Reiter | A45C 13/26 150/107 |
| D615,280 | S | 5/2010 | Graulich | |
| 8,850,665 | B2 * | 10/2014 | Watrach | A41F 19/005 9/5 |
| 2010/0327031 | A1 * | 12/2010 | Olmos | A45F 5/02 224/269 |
| 2011/0173782 | A1 | 7/2011 | English | |
| 2011/0252607 | A1 * | 10/2011 | Rothbaum | B65H 75/285 24/303 |
| 2011/0290829 | A1 | 12/2011 | Watrach | |
| 2012/0170428 | A1 | 7/2012 | Stavrovski | |
| 2014/0101894 | A1 * | 4/2014 | Parascandolo | A44C 5/18 24/3.2 |
| 2015/0112168 | A1 | 4/2015 | Conrad et al. | |

* cited by examiner

SLEEVE AND GLOVE KEEPER WATCH BRACKET

RELATED APPLICATION

This application is a continuation-in-part application of co-pending non-provisional patent application entitled "Sleeve and Glove Keeper Watch Bracket," Ser. No. 14/217,729 filed on Mar. 18, 2014, which is a continuation-in-part application of co-pending non-provisional patent application entitled "Sleeve Keeper Watch Bracket," Ser. No. 14/138,248 filed on Dec. 23, 2013, all of which incorporated herein by reference.

FIELD

This disclosure relates to wrist accessories, and is related in particular to a sleeve and glove keeper watch bracket.

BACKGROUND

Many of today's garments worn by both men and women feature long sleeves that reach the wearer's wrist, such as dress shirts, blouses, suit jackets, windbreakers, dress coats, rain coats, tunics, hoodies, etc. When wearing these long-sleeve garments, the wearer must push back the sleeve when the arm is raised to reveal a wristwatch or computer wrist-band worn on the wrist such as an activity or fitness monitor. Therefore, gaining visual access to the watch or fitness bracelet becomes a two-handed operation that may be impractical or inconvenient at times, such as when the wearer is operating machinery or carrying a package, an umbrella, a purse, a suitcase, luggage, etc.

Similarly, the watch or fitness wristband can also be easily obscured by a glove worn during the Winter or on certain types of jobs. When reading the time on a watch, a person may have to pull back both the sleeve cuff as well as the glove in opposite directions to reveal the watch face or computer wristband digital readout.

DETAILED DESCRIPTION

Although the description herein primarily relates to a wristwatch, the bracket mechanism described herein may be easily adapted to computer devices worn on the wrist, such as fitness wristbands, activity trackers, wellness monitors, and other devices. These computer devices may include a digital readout or a small display that provides the user's activity data and information about the user's surroundings, such as pulse rate, distance traveled, temperature, humidity, location, etc. It should be noted that the bracket mechanism described herein may be adapted to retain sleeves as well as gloves from obscuring the watch face or digital readout of the computer wristband.

Figure 1:
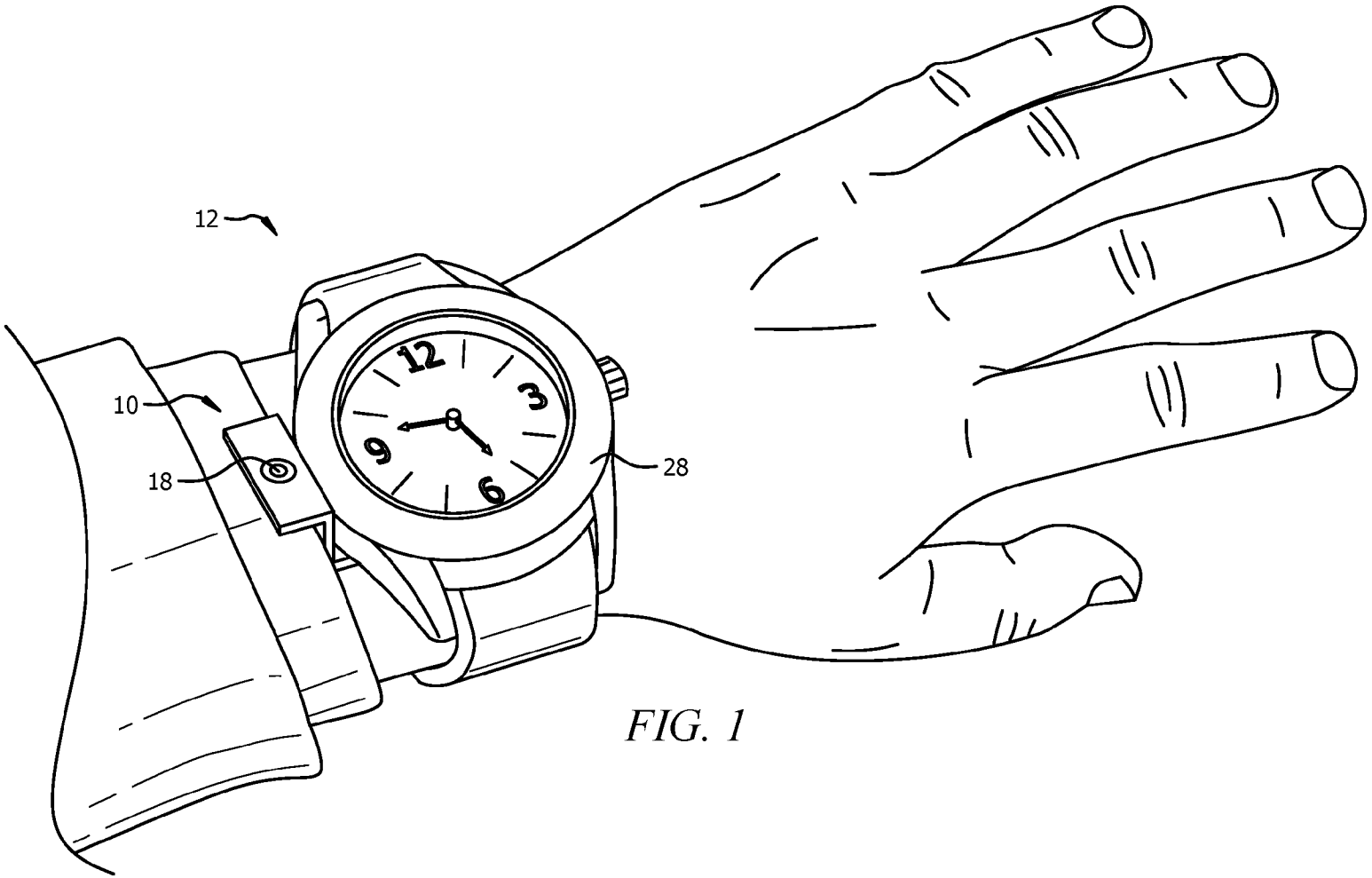
FIG. 1 is a perspective view of an exemplary embodiment of a sleeve keeper watch bracket in use with a wristwatch according to the teachings of the present disclosure.
Figure 2:
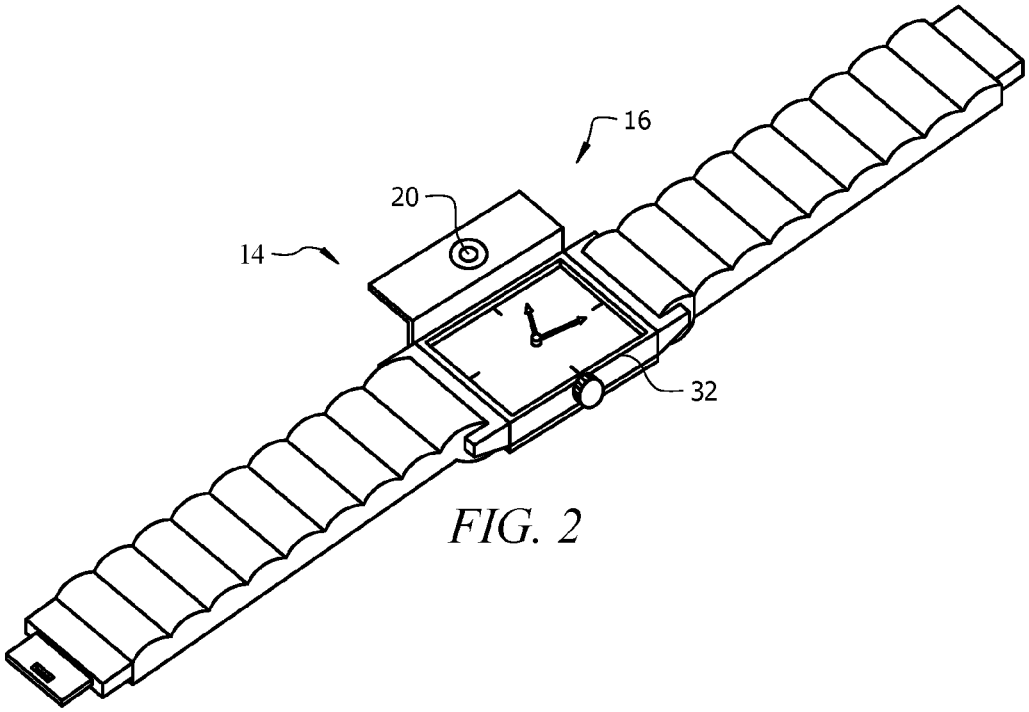
FIG. 2 is another perspective view of an exemplary embodiment of a sleeve keeper watch bracket in use with a wristwatch according to the teachings of the present disclosure.
Figure 3:
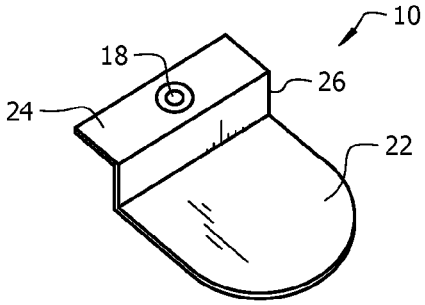
FIG. 3 is a perspective view of an exemplary embodiment of a sleeve keeper watch bracket according to the teachings of the present disclosure.
Figure 4:
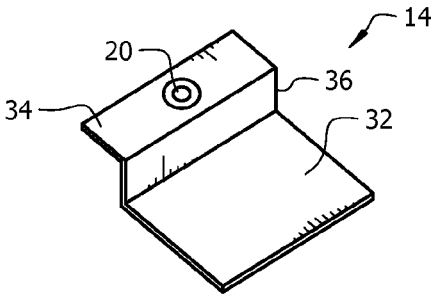
FIG. 4 is a perspective view of another exemplary embodiment of a sleeve keeper watch bracket according to the teachings of the present disclosure.

FIG. 1 is a perspective view of an exemplary embodiment of a sleeve keeper watch bracket 10 in use with a round-faced wristwatch 12 according to the teachings of the present disclosure. The sleeve keeper watch bracket 10 can be a component that a user can add onto an existing wristwatch or computer wristband 12, or the wristwatch or computer wristband 12 can be made with the bracket 10 integrally built-in. FIG. 2 is a perspective view of an exemplary embodiment of a sleeve keeper watch bracket 14 in use with a square-faced wristwatch 16 according to the teachings of the present disclosure. Both sleeve keeper watch brackets 10 and 14 incorporate a lighting element 18 and 20 that may be decorative or functional in nature. FIGS. 3 and 4 are perspective views of the sleeve keeper watch bracket 10 and 14 according to the teachings of the present disclosure.

Figure 5:
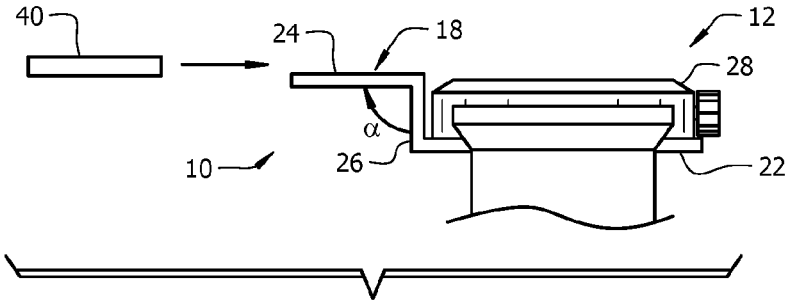
FIG. 5 is an end view (with watch band removed) of an exemplary embodiment of a sleeve keeper watch bracket and decorative cover in use with a wristwatch according to the teachings of the present disclosure.
Figure 9:
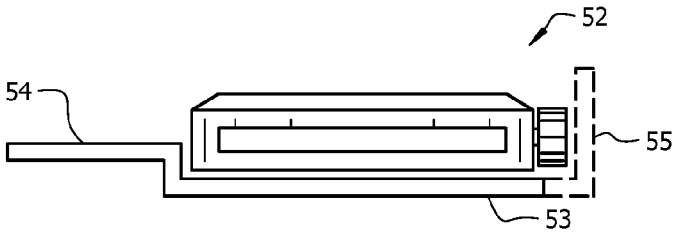
FIG. 9 is an end view (with watch band removed) of yet another exemplary embodiment of a sleeve and glove keeper watch bracket in use with a wristwatch according to the teachings of the present disclosure.

Referring to FIG. 3, the sleeve keeper watch bracket 10 includes a substantially rectangular first member 22 with a generally planar surface, and a secondary member 24 also with a generally planar surface, where the main member 22 and secondary member 24 are securely linked or connected by a connecting member 26. As best seen in FIG. 5, the main member 22 and secondary member 24 generally lie on two different but parallel planes, where the secondary member 24 is generally on a plane elevated above the plane of the main member 22. As seen in the end view in FIG. 5, the angle $\alpha$ between secondary member 24 and connecting member 26 is generally a right angle (90°), but it may be an angle less than 90° (an acute angle) or greater than 90° (an obtuse angle). In a preferred embodiment, connecting member 26 is at right angles to both main member 22 and secondary member 24. Preferably, the connecting member 26 extends a distance generally equal to the thickness of the wristwatch case 28, so that the secondary member 24 is generally co-planar with the face of the wristwatch. Alternatively, the secondary member 24 may be on a plane below the face of the wristwatch as shown in FIG. 9.

Referring to FIG. 4, the sleeve keeper watch bracket 14 includes a substantially circular first member 32 with a generally planar surface, and a secondary member 34 also with a generally planar surface, where the main member 32 and secondary member 34 are securely linked or connected by a connecting member 36.

Accordingly, the first member preferably echo the general shape, size, and configuration of the watch case. The length of the secondary member 24 and 34 is preferably such that the wearer's sleeve remain retained under the secondary member with the full range of arm motion, such as with the arm raised overhead and raised to the side, for example. The main member 22 and 32 may alternately form part of the watch case or computer wristband and be integral therewith, be detachably secured to the watch case (using, e.g., double-sided tape, hook-and-loop tape, etc.) or be permanently secured to the watch case or computer wristband (using, e.g., adhesives, bonding agents, two-part epoxy, etc.). The bracket may be constructed of a sturdy and rigid material such as metal, plastics, composites, etc. For example, the bracket may be constructed from a rectangular strip of metal bent to the desired shape and configuration.

Further shown in FIGS. 1-4 are lighting elements 18 and 20 disposed on secondary member 24 and 34, such as one or more LED (light emitting diodes) for lighting (flashlight) and/or ornamental purposes. The lighting element may point in a direction away from the secondary member 24 and 34 or along an axis parallel with the plane of the secondary member 24 and 34. The lighting element may be powered by a small disc battery and turned on/off by a small hidden switch (not shown). Using the lighting element, the wearer may move his/her hand and wrist to aim the emitted light, which may be in one or more colors.

Figure 6:
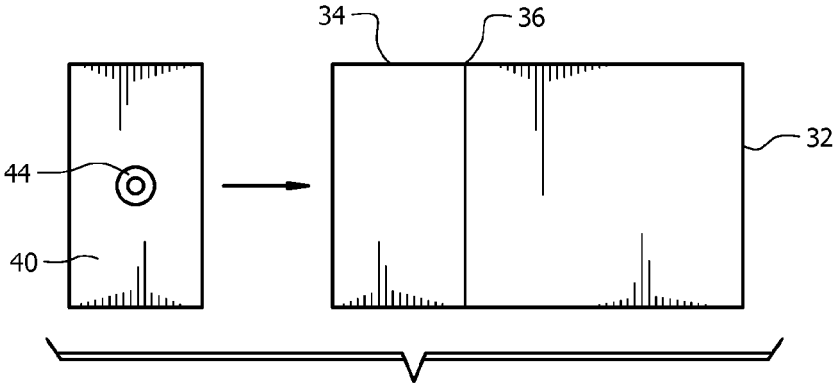
FIG. 6 is a top view of an exemplary embodiment of a sleeve keeper watch bracket and decorative cover according to the teachings of the present disclosure.
Figure 7:
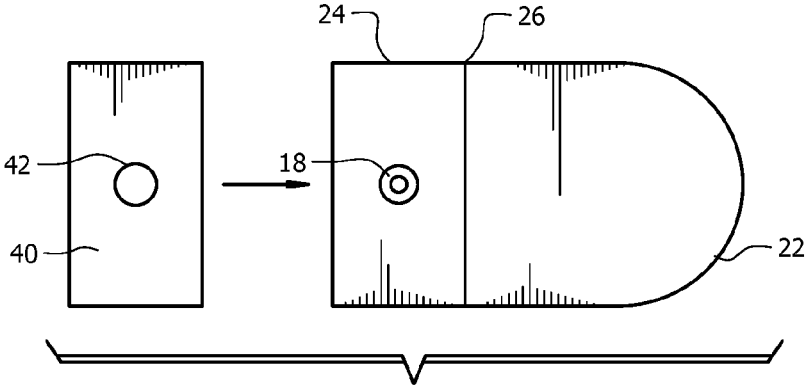
FIG. 7 is a top view (with watch band removed) of another exemplary embodiment of a sleeve keeper watch bracket and decorative cover according to the teachings of the present disclosure.

FIG. 5 is a an end view (with watch band removed for clarity) of an exemplary embodiment of a sleeve keeper watch bracket 10 and decorative cover 40 in use with a wristwatch 12 according to the teachings of the present disclosure. FIGS. 6 and 7 are top views of exemplary embodiments of a sleeve keeper watch bracket and decorative cover 40 according to the teachings of the present disclosure. The decorative cover 40 preferably fits snugly and securely (e.g., friction fit or using low-tack re-adherable adhesive) over the secondary member, and can be of a shade that is identical, close to, or complementary to the color of the garment sleeve. The decorative cover 40 may also complement the colors and tones found in the watch case and/or band. For example, if the watch band is of a dark brown leather, the decorative cover 40 may be constructed of the same material. The decorative cover 40 may additionally incorporate ornamental designs, beading, jewels, graphics, monograms, logos, fabrics, lights, and other decorative elements. Because the decorative cover 40 may be easily removed, the wearer may choose interchangeable designs and colors that hides or diminishes the visual impact of the bracket, or enhance and contribute to the wristwatch design. The decorative cover 40 may be constructed of plastic, rubber, fabric, leather, sued, metal, and/or a number of other suitable materials. In FIG. 7, an opening 42 is defined in the decorative cover 40 to allow the lighting element 18 on the secondary member 24 to emit its light. In FIG. 6, the cover 40 incorporates a lighting element 44 for decorative and/or functional purposes.

In these embodiments, the underside surface of the secondary member 24 and 34 that faces the garment sleeve may further incorporate a material that tends to engage, adhere, or stick to the sleeve. For example, using just the hook portion of the hook-and-loop tape on the underside surface may help to engage the garment sleeve and retain it under the bracket. Other suitable materials may be used. The material may be adhered or applied to the secondary member 24 and 34. Alternatively, the underside of decorative cover 40 may incorporate the tacky material to encourage the garment sleeve to be retained thereunder.

In alternate embodiments, the secondary member 24 and 34 may be hinged at its interface to the connecting member 26 and 36, and may even be spring-loaded to help push down and retain the sleeve underneath it toward the wearer's arm.

Yet in another alternate embodiment, the secondary member 24 and 34 may be generally identical or similar in shape and size as the watch face or computer wristband, so that in the closed state or position, the secondary member 24 and 34 may fold over the face of the wristwatch and act as a cover for the face of the wristwatch. Upon detection of the wearer's arm being raised in a substantially horizontal manner, as when the wearer desires to look at the wristwatch worn on the wrist, the secondary member 24 and 34 may automatically spring from the closed position to an open position, revealing the face of the wristwatch and holding back the garment sleeve at the same time. The secondary member 24 and 34 may incorporate ornamental designs on both surfaces to enhance the beauty of the wristwatch. A microprocessor, motion sensors, electric and/or piezoelectric actuators, spring-loaded hinges, latches, and other devices may be used to achieve these functionalities.

Figure 8:
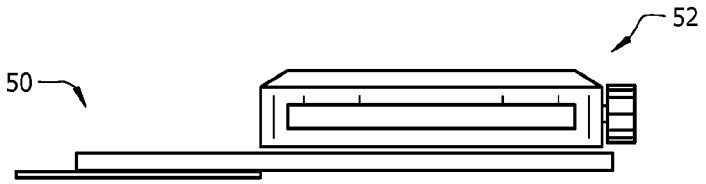
FIG. 8 is an end view (with watch band removed) of another exemplary embodiment of a sleeve keeper watch bracket in use with a wristwatch according to the teachings of the present disclosure.

FIG. 8 is an end view of another exemplary embodiment of a sleeve keeper watch bracket 50 in use with a wristwatch 52 according to the teachings of the present disclosure. This embodiment employs a watch bracket 50 that is a generally planar plate adhered or incorporated to the wristwatch case or computer wristband. The plate may be a rectangular flat metal plate that extends from under the wristwatch case toward the garment sleeve, and is operable to retain the sleeve underneath it. The extended member may incorporate a decorative cover, a spring-loaded retainer, and/or sleeve-retention material as set forth above. In this embodiment, the sleeve keeper watch bracket has a slimmer combined profile the embodiments shown in FIGS. 1-7 and is not as bulky.

FIG. 9 is an end view of an exemplary embodiment of a sleeve and glove keeper watch bracket in use with a wristwatch 52 according to the teachings of the present disclosure. Its main member 53 is disposed below the wristwatch case or computer wristband. Alternatively, the bracket may be incorporated as a part of the watch case or computer wristband. The secondary member 54 extends toward the garment sleeve and has the functionality of retaining the garment sleeve. However, the secondary member 54 generally lies in a plane above the back of the watch case but lower than the watch face. Further, an optional third member 55 is provided on the other side of the watch that extends substantially in a right angle from the first member 53 and reaches slightly above the plane of the watch face to hold back a glove worn by a user. In this embodiment, the sleeve and glove keeper watch bracket 54 has a somewhat slimmer profile than the embodiments shown in FIGS. 1-7 and is not as bulky.

Figure 10:
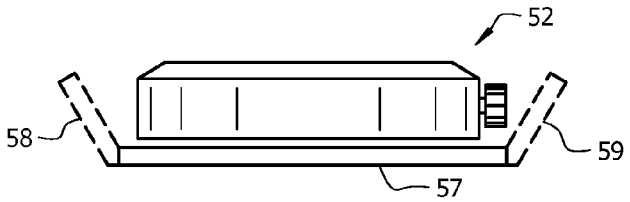
FIG. 10 is an end view (with watch band removed) of yet another exemplary embodiment of a sleeve and glove keeper watch bracket in use with a wristwatch according to the teachings of the present disclosure.

FIG. 10 is an end view of another exemplary embodiment of a sleeve and glove keeper watch bracket in use with a wristwatch 52 according to the teachings of the present disclosure. Its first member 57 is disposed below the wristwatch case or computer wristband or incorporated as a part thereof. A secondary member 58 is coupled to the first member 57 and extends at an acute angle toward the garment sleeve with the functionality of retaining the garment sleeve. Further, an optional third member 59 is provided on the other side of the watch that also extends at an acute angle toward a glove worn by a user. In this embodiment, the sleeve and glove keeper watch bracket is able to hold back both the sleeve and glove to provide an unobscured view of the watch face or computer display to the wearer.

It should be noted that any embodiments disclosed herein can be outfitted with the glove keeper member shown in FIG. 9 or 10 to provide the additional functionality of retaining the glove away from the watch face or computer device readout. The watch bracket embodiments disclosed herein may employ only the sleeve keeper member, only the glove keeper member, or with both the sleeve and glove members. It should be noted that any of the embodiments described herein for retaining the garment sleeve may be adapted for the purpose of retaining the glove.

Figure 11:
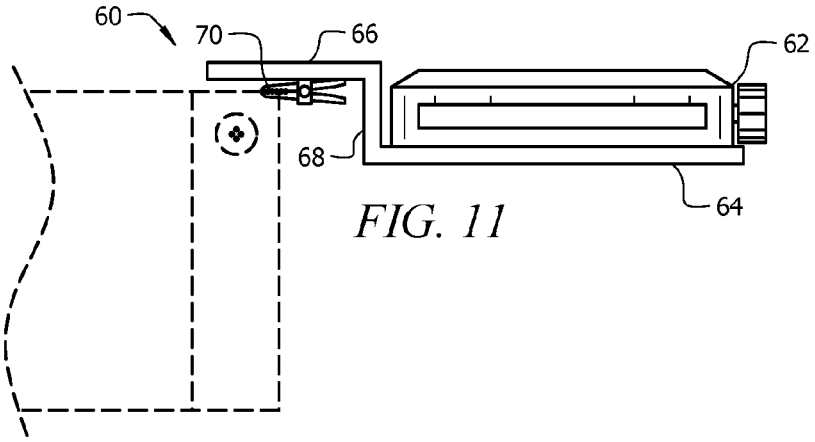
FIG. 11 is an end view (with watch band removed) of yet another exemplary embodiment of a sleeve keeper watch bracket in use with a wristwatch according to the teachings of the present disclosure.

FIG. 11 is an end view (with watch band removed) of yet another exemplary embodiment of a sleeve keeper watch bracket 60 in use with a wristwatch 62 according to the teachings of the present disclosure. In this embodiment, the main member 64 is connected to a secondary member 66 via a connecting member 68. Unlike using a tacky material as described above, the secondary member 66 of this embodiment incorporates a sleeve retention element in the form of a spring-loaded clip or clamp 70. In operation, the user clips the garment sleeve to the bracket with the clip 70 so that the sleeve is securely held back from the watch face or computer display.

Figure 12A:
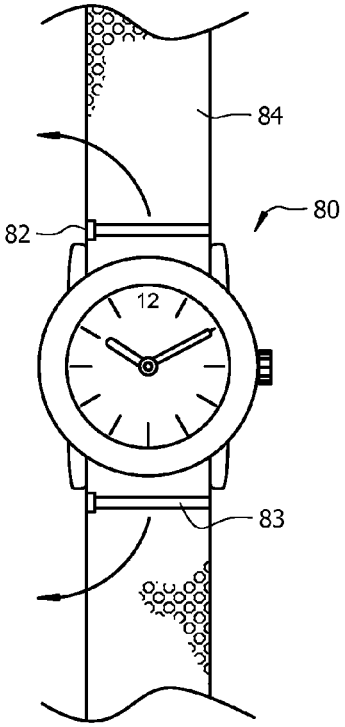
FIGS. 12A and 12B are top views of yet another exemplary embodiment of a sleeve keeper watch bracket in use with a wristwatch according to the teachings of the present disclosure.
Figure 12B:
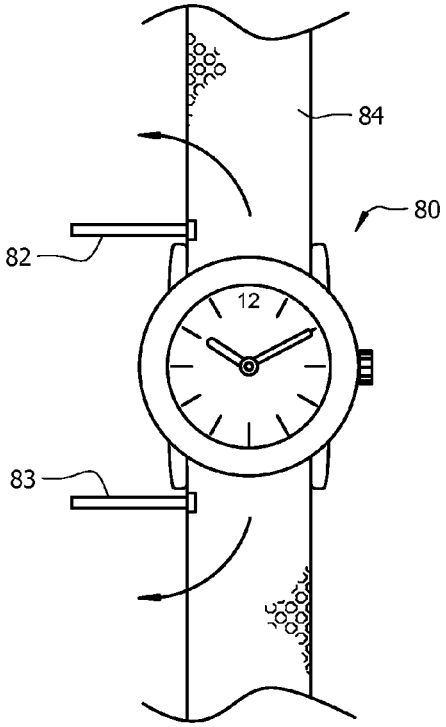

FIGS. 12A and 12B are top views of yet another exemplary embodiment of a sleeve keeper watch bracket 80 in use with a wristwatch according to the teachings of the present disclosure. In this embodiment, two spring-loaded members/fingers 82 and 83 are operable to go from a first closed state resting on the watch or computer wristband 84, to swing or flip to an open state so that they protrude from the wristband 84 in substantially perpendicular relation thereto and hold back the garment sleeve. In this way, the garment sleeve is held back and the wristwatch can be easily seen without two-handed operations. A microprocessor, motion sensors, actuator, spring-loaded hinges, and latches may be used to achieve these functionalities.

Figure 13A:
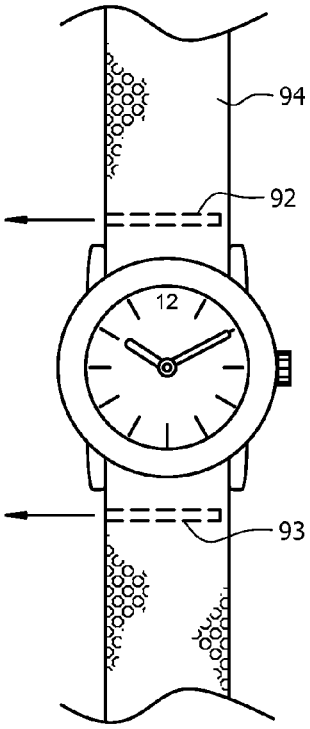
FIGS. 13A and 13B are top views of yet another exemplary embodiment of a sleeve keeper watch bracket in use with a wristwatch according to the teachings of the present disclosure.
Figure 13B:
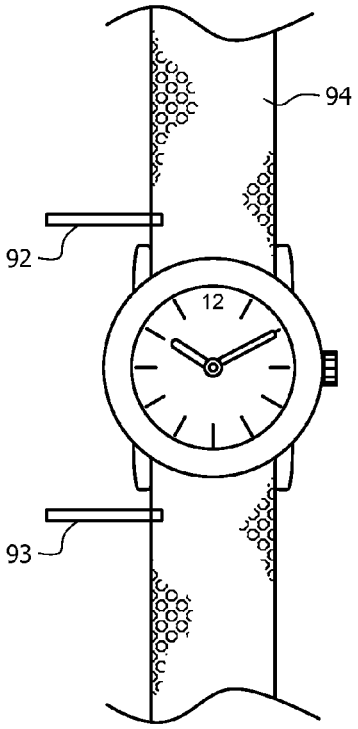

FIGS. 13A and 13B are top views of yet another exemplary embodiment of a sleeve keeper watch bracket 90 in use with a wristwatch according to the teachings of the present disclosure. In this embodiment, two members/fingers 92 and 93 may be hidden and stored inside the watch or computer wristband 94. When the wearer desires to deploy the sleeve keeping function, the wearer can pull out or actuate the two members/fingers so that they protrude from the wristband 94 in substantially perpendicular relation thereto and hold back the garment sleeve. Alternatively, the two members may deploy automatically when sensing the wearer's arm motion that indicate a desire to view the timepiece or computer display.

Figure 14A:
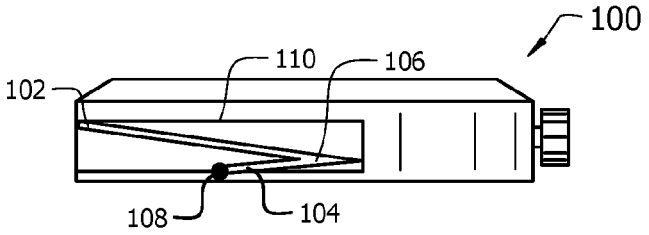
FIGS. 14A-14C are partial cut-away end views (with watch band removed) of yet another exemplary embodiment of a sleeve keeper watch bracket showing various stages of deployment according to the teachings of the present disclosure.
Figure 14B:
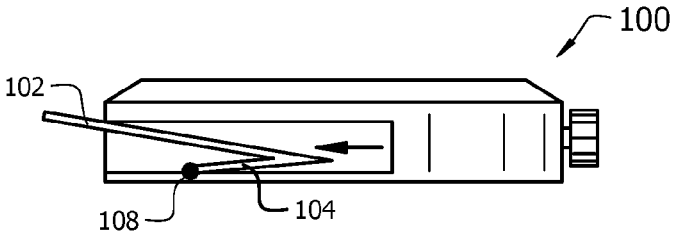
Figure 14C:
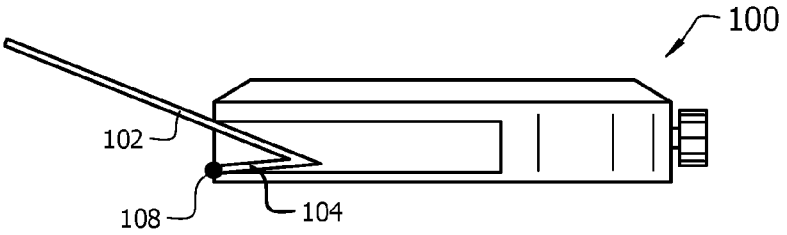

FIGS. 14A-14C are partial cut-away end views (with watch band removed) of yet another exemplary embodiment of a sleeve keeper watch bracket 100 showing various stages of deployment according to the teachings of the present disclosure. The bracket mechanism 100 includes two elongated members 102 and 104 connected at a point 106. The elongated member 104 is further connected to a deployment mechanism at a point 108. The bracket mechanism 100 can be entirely enclosed in a cavity 110 defined in the wristwatch or computer wristband. The bracket 100 is deployed as the attachment point 108 is displaced outward toward an opening of the cavity 110 disposed on the side of the watch case facing the user's arm (for sleeve retention) or the user's hand (for glove retention). When the bracket 100 is fully deployed, the elongated member 102 projects upward and outward toward the user's arm and is adapted to retain the edges of the user's sleeves from encroaching the face of the watch or display of a computer wristband. The deployment and concealment of the bracket 100 may be automatically triggered by motion sensors or by the user's actuation of a switch.

It should be noted that the bracket 100 may be constructed from a narrow segment of material such as metal or plastic bent or formed to the proper shape. Alternately, the bracket 100 may be formed from a flat plate of metal or other material that include a third dimension extending substantially the width of the watch case or computer display. It should further be noted that the size of the cavity and bracket are shown exaggerated relative to the watch case in FIGS. 14A-14C to better demonstrate the concept of this bracket configuration.

Figure 15A:
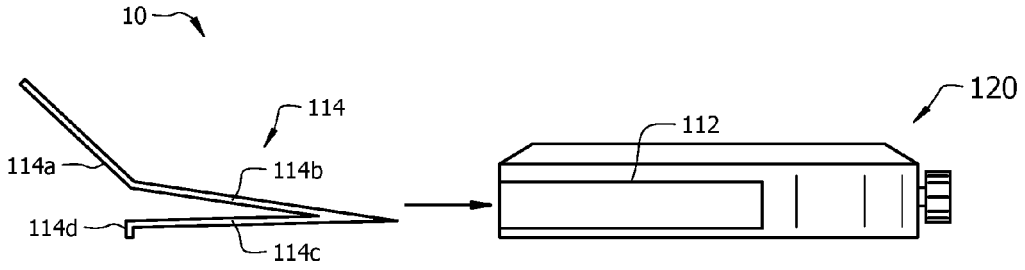
FIGS. 15A and 15B are partial cut-away end views (with watch band removed) of yet another exemplary embodiment of a sleeve keeper watch bracket according to the teachings of the present disclosure.
Figure 15B:
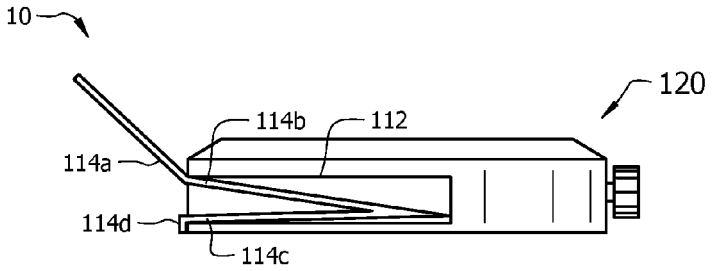

FIGS. 15 A and 15B are partial cut-away end views (with watch band removed) of yet another exemplary embodiment of a sleeve keeper watch bracket 120 showing various stages of deployment according to the teachings of the present disclosure. The bracket 120 includes a cavity 112 formed in the watch case or computer wristband. The bracket 120 includes a bracket member 114 that is specially shaped and formed. The bracket member 114 may be constructed from a flat rectangular plate or a narrow length of material. The bracket 120 is shaped to include a general wedge configuration, with an upright member 114*a* that is adapted to restrain the sleeve, and wedge members 114*b* and 114*c* that are adapted to be inserted into the cavity 112 and to friction hold the bracket in place. A fourth bracket member or tab 114*d* may be formed to hold against the watch case or computer wristband.

In this embodiment, the bracket 120 can be deployed by inserting it into the cavity 112, and removed when it is no longer needed. It should further be noted that the size of the cavity and bracket are exaggerated relative to the watch case in FIGS. 15A 15B to better demonstrate the concept of this bracket configuration.

Figure 16A:
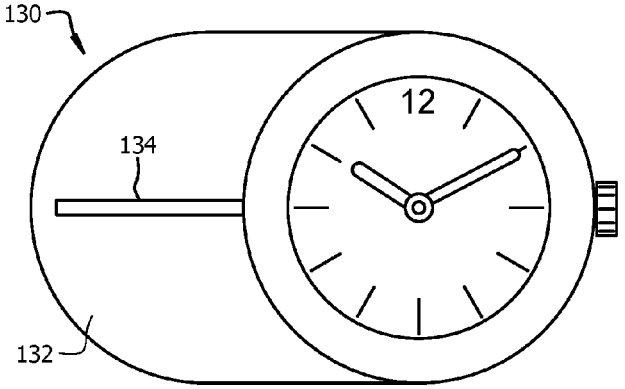
FIGS. 16A and 16B are top and end views of yet another exemplary embodiment of a sleeve keeper watch bracket according to the teachings of the present disclosure.
Figure 16B:
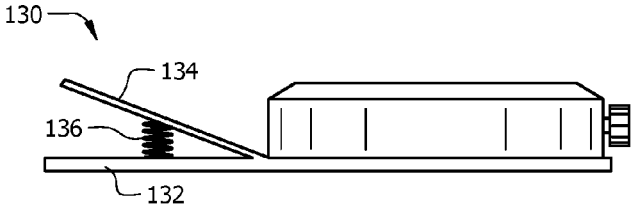

FIGS. 16A and 16B are top and end views of an exemplary embodiment of a sleeve keeper watch bracket 130 according to the teachings of the present disclosure. The bracket 130 includes a bottom plate 132 that is adhered to the bottom of the watch case or computer wristband. A clip constructed of a top member 134 and a spring element 136 are coupled to the bottom plate 132. The clip may be used to hold the edge of a sleeve to the bottom plate 132 and to keep the sleeve restrained from obscuring the watch face or computer display.

Figure 17A:
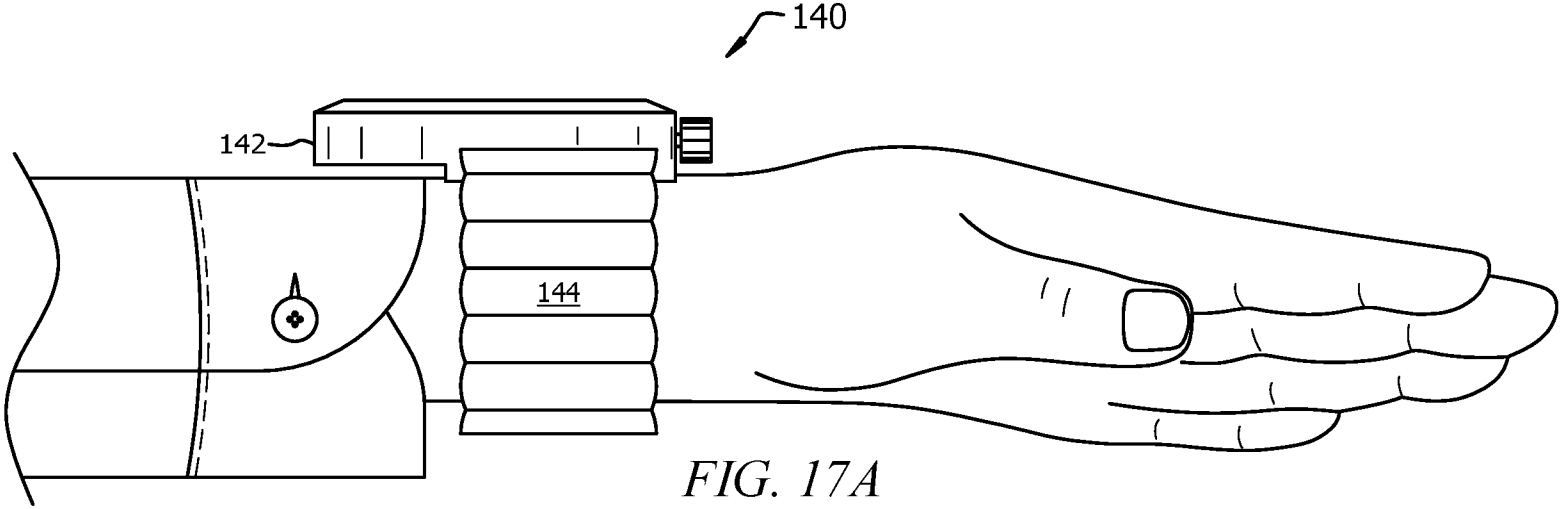
FIG. 17A is an end view of an exemplary embodiment of a sleeve keeper watch according to the teachings of the present disclosure.
Figure 17B:
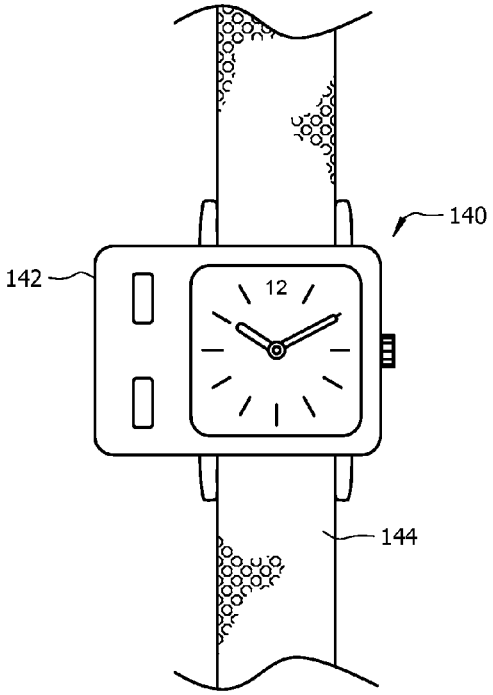
FIGS. 17B and 17C are top views of additional exemplary embodiments of a sleeve keeper watch according to the teachings of the present disclosure.
Figure 17C:
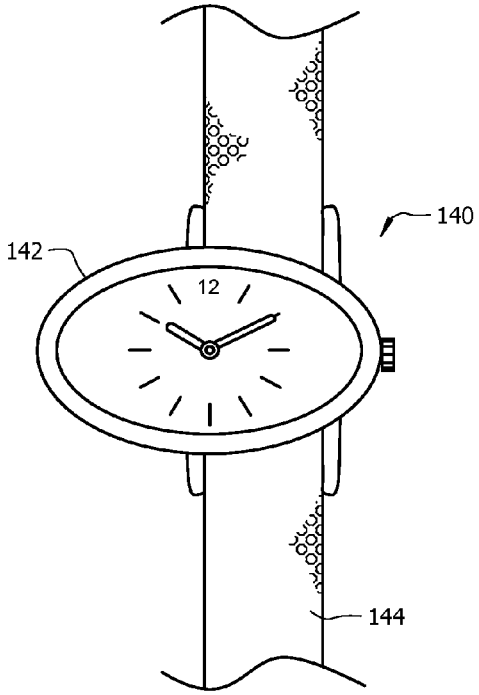

FIGS. 17A-17C are end and top views of an exemplary embodiments of a sleeve keeper watch 140 according to the teachings of the present disclosure. The sleeve keeper watch bracket in this embodiment is integrated and incorporated as part of the watch case itself. The sleeve keeper watch 140 includes a watch case 142 coupled to a wristband 144. The point of attachment of the wristband 144 to the watch case 142 is offset from the center, so that a substantial portion of the watch case may overhang and retain the sleeve of the user's garment under the watch case. It may be seen that the watch face may take on any desirable shape or dimension. The same concept may be adapted to retain the glove, where the wrist accessory would have overhang portions on both sides to retain the sleeve as well as the glove. The watch case 142 may additionally accommodate lighting elements or other decorative elements.

Figure 18:
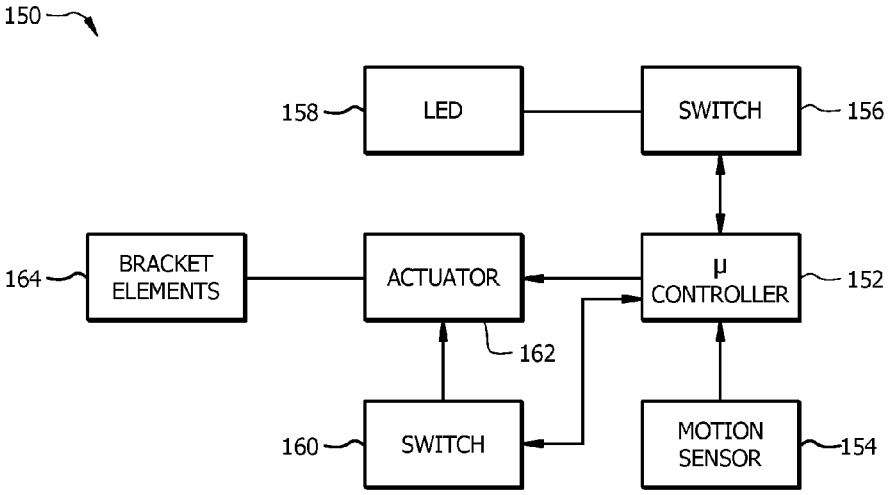
FIG. 18 is a simplified block diagram of an exemplary embodiment of a microcontroller circuit adapted for controlling and deploying the sleeve and glove keeper watch bracket according to the teachings of the present disclosure.

FIG. 18 is a simplified block diagram of an exemplary embodiment of a microcontroller circuit 150 adapted for controlling and deploying the sleeve and glove keeper watch bracket according to the teachings of the present disclosure. The microcontroller circuit 150 may be part of a timekeeping circuitry, fitness monitoring circuitry, or other circuitry. The microcontroller circuit 150 includes a microcontroller or microprocessor 152 coupled to a number of sensor elements 154 that provides input thereto, such as motion sensor 154, temperature sensor, pulse rate monitor, etc. The motion sensor is adapted to sense specific motion and orientation of the user's arm and wrist as triggers for automatically deploying the watch and glove bracket. The temperature sensor is adapted to measure the surrounding temperature and the pulse rate monitor is adapted to take the pulse of the wearer. The microprocessor or microcontroller circuit 152 may include communication transceiver circuitry that is adapted to communicate wirelessly with nearby computing devices via one or more suitable communication or telecommunication protocols (e.g., WiFi, Bluetooth, infrared, 4G LTE, etc.) that are adapted to provide it access to the Internet and other data resources. The circuit 150 further includes a display that is adapted to receive output from the microprocessor 152 and display data such as time, pulse rate, step count, distance traveled, calories burned, temperature, weather, location, altitude, etc. The circuit 150 further includes a switch 156 for turning on/off the lighting element or LED 158.

The microcontroller 152 is further coupled to a second switch 160 coupled to an actuator 162 that enables the user to activate or trigger the deployment of the bracket elements 164 by using the switch 160. The actuator 162 may be an electric or piezoelectric actuator adapted to cause a displacement or motion in the bracket elements 164 so that it may be deployed to a sleeve/glove retaining status or position, and then returned to original status or position.

In operation, a user may lift his/her arm and turn the wrist to view the timepiece or computer wristband. The motion sensor 154 is adapted to detect these motions and automatically deploy the bracket mechanism 164. When the user lowers his/her arm, the motion sensor 154 is adapted to detect this motion and automatically return to the original position. Alternatively, the user may use the switch 160 to activate or deactivate the bracket mechanism 164.

Figure 19:
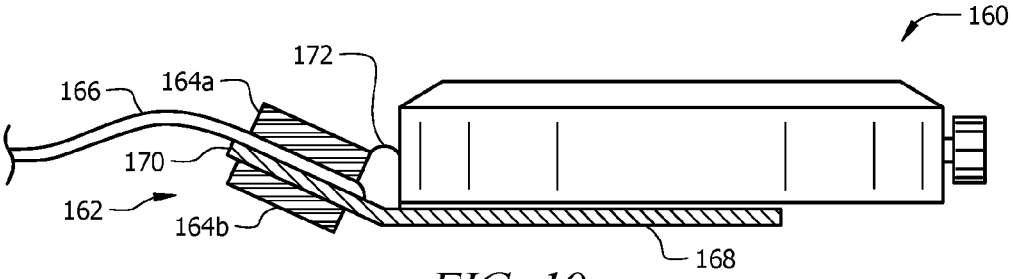
FIG. 19 is an end view of yet another exemplary embodiment of a sleeve keeper watch according to the teachings of the present disclosure.

FIG. 19 is an end view of yet another exemplary embodiment of a sleeve keeper watch 160 according to the teachings of the present disclosure. This embodiment of the watch 160 utilizes a sleeve keeper 162 that incorporates the properties of magnets or magnetic components 164*a* and 164*b* to secure the sleeve 166. The sleeve keeper 162 includes a first generally planar member 168 secured to a backside of the watch case using a permanent adhesive or temporary fastener. The first planar member 168 is coupled to a second planar member 170 at an obtuse angle (or at an acute angle relative to the plane of the watch case). A magnet or magnetic component 164*b* is securely fastened to an underside of the second planar member 170, and another magnet or magnetic component 164*a* is coupled to the planar members 168 and 170 by a flexible wire or a short length of chain 172. In operation, the sleeve 166 is held to the sleeve keeper planar member 170 between magnets 164*a* and 164*b*. The magnetic attraction force causes the magnets 164*a* and 164*b* to tightly couple together and thus securing the sleeve to the planar member 170 of the sleeve keeper 162. In this embodiment, the second planar member 170 may itself be magnetic, so that the garment sleeve may be secured between the magnetic member 164*a* and the second planar member 170 under the attraction forces therebetween (without the use of magnetic member 164*b*).

Figure 20:
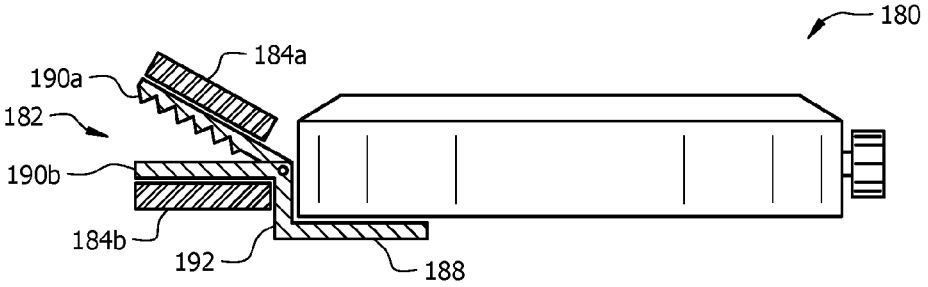
FIG. 20 is an end view of yet another exemplary embodiment of a sleeve keeper watch according to the teachings of the present disclosure.

FIG. 20 is an end view of yet another exemplary embodiment of a sleeve keeper watch 180 according to the teachings of the present disclosure. This embodiment of the watch 180 utilizes a sleeve keeper 182 that also incorporates the properties of magnets or magnetic components 184*a* and 184*b* to secure the long sleeve. The sleeve keeper 182 includes a first generally planar member 188 secured to a backside of the watch case using a permanent adhesive or temporary fastener. The first planar member 188 is coupled to members 190*a* and 190*b* that are coupled together by a hinge. Therefore, members 190*a* and 190*b* act like pincers held together at a hinged pivot point. A magnet or magnetic component 184*b* is securely fastened to an underside of the top pincer member 190*b*, and another magnet or magnetic component 184*a* is coupled to an upper side of the bottom pincer member 190*a*. The underside surface of the top pincer member 190*a* may incorporate "teeth," fine hooks, or a rough textured surface to increase the hold on the sleeve held between the pincer members 190*a* and 190*b*. In operation, the sleeve is held tightly between the sleeve keeper pincer members 190*a* and 190*b*. The magnetic attraction force causes the magnets 184*a* and 184*b* to tightly come together and thus securing the sleeve between the sleeve keeper pincer members 190*a* and 190*b*. It should be noted that in this embodiment, the first and second pincer members 190*a* and 190*b* may themselves be magnetic, so that the garment sleeve may be secured between the first and second pincer members 190*a* and 190*b* under sufficient attraction forces therebetween (without the use of magnetic members 184*a* and 184*b*).

The bracket mechanism described herein can be made to be part of a wristwatch, computer wristband, decorative bracelet, and like accessories worn on the wrist. The bracket mechanism is operable to retain the garment sleeve cuff and/or glove to reveal the wrist accessory.

The features of the present invention which are believed to be novel are set forth below with particularity in the appended claims. However, modifications, variations, and changes to the exemplary embodiments described above will be apparent to those skilled in the art, and the sleeve and glove keeper watch bracket described herein thus encompasses such modifications, variations, and changes and are not limited to the specific embodiments described herein.

What is claimed is:

1. A sleeve keeper for use with a wrist accessory having a wristband worn around a wrist of a user, comprising:

a first magnetic member coupled to the wrist accessory and extending toward the user's arm, the first magnetic member being separate, apart from, and not form any part of the wristband; and a second magnetic member also coupled to the wrist accessory and also extending toward the user's arm, the second magnetic member being separate, apart from, and not form any part of the wristband, the second magnetic member being attracted to the first magnetic member to hold and retain, between the first and second magnetic members, a long sleeve of a garment worn by the user from obscuring the wrist accessory.

2. The sleeve keeper of claim 1, wherein the wrist accessory includes a wristwatch with a watch case, the second magnetic member being secured to a planar member affixed to a bottom surface of the watch case, the second magnetic member extending away from the wristwatch toward the garment sleeve when worn by the user.

3. The sleeve keeper of claim 1, wherein the first magnetic member is coupled to the wrist accessory by a flexible element.

4. The sleeve keeper of claim 1, wherein the first magnetic member is coupled to the wrist accessory by a flexible element selected from the group consisting of a chain and a wire.

5. The sleeve keeper of claim 1, wherein the first magnetic member is coupled to a top side of a first pincer member coupled to the wrist accessory, and the second magnetic member is coupled to a bottom side of a second pincer member coupled to the wrist accessory, the first and second pincer members being coupled together by a hinge, the pincer members being forced to come together by the first and second magnetic members to hold and retain the garment sleeve.

6. The sleeve keeper of claim 5, wherein a bottom side of the first pincer member comprises a textured surface.

7. The sleeve keeper of claim 5, wherein a bottom side of the first pincer member comprises a plurality of fastening elements.

8. A sleeve keeper coupled to a wristwatch having a watch case and a wristband worn around the wrist of a user, comprising:

a first magnetic member coupled to the watch case of the wristwatch, the first magnetic member being separate, apart from, and not form any part of the wristband; and a second magnetic member coupled to the watch case of the wristwatch, the second magnetic member being separate, apart from, and not form any part of the wristband, and the second magnetic member being attracted by magnetic forces to the first magnetic member to hold and retain, between the first and second magnetic members, a long sleeve of a garment worn by the user from obscuring the wristwatch.

9. The sleeve keeper of claim 8, wherein the first and second magnetic members are pivotally coupled together by a hinge so that the first and second magnetic members operate as pincer members.

10. The sleeve keeper of claim 8, wherein the second magnetic extends away from the wristwatch toward the garment sleeve when worn by the user.

11. The sleeve keeper of claim 8, wherein the first magnetic member is coupled to the wristwatch by a flexible element.

12. The sleeve keeper of claim 8, wherein the first magnetic member is coupled to the wristwatch by a flexible element selected from the group consisting of a chain and a wire.

13. The sleeve keeper of claim 8, wherein a bottom side of the first magnetic member comprises a textured surface.

14. The sleeve keeper of claim 8, wherein a top side of the second magnetic member comprises a textured surface.

15. The sleeve keeper of claim 8, wherein a bottom side of the first magnetic member and a top side of the second magnetic member comprise a plurality of sleeve fastening elements.

16. A sleeve keeper for use with a wrist watch having a watch case with a wristband worn around a wrist of a user, comprising:

a first magnetic member coupled to the watch case and extending away from the watch case and toward the user's arm, the first magnetic member being separate, apart from, and not form any part of the wristband; and a second magnetic member coupled to a bottom surface of the watch case and also extending toward the user's arm, the second magnetic member being separate, apart from, and not form any part of the wristband, the first and second magnetic members being attracted together to hold and retain therebetween a long sleeve of a garment worn by the user and thereby preventing the garment sleeve from obscuring the wrist watch.

* * * * *